US006873301B1

(12) United States Patent
Lopez

(10) Patent No.: US 6,873,301 B1
(45) Date of Patent: Mar. 29, 2005

(54) DIAMOND ARRAY LOW-SIDELOBES FLAT-PLATE ANTENNA SYSTEMS FOR SATELLITE COMMUNICATION

(75) Inventor: Alfred R. Lopez, Commack, NY (US)

(73) Assignee: BAE Systems Information and Electronic Systems Integration Inc., Greenlawn, NY (US)

( * ) Notice: Subject to any disclaimer, the term of this patent is extended or adjusted under 35 U.S.C. 154(b) by 0 days.

(21) Appl. No.: 10/680,485

(22) Filed: Oct. 7, 2003

(51) Int. Cl.[7] ..... H01Q 13/10
(52) U.S. Cl. ..... 343/770; 343/754; 342/376
(58) Field of Search ..... 343/770, 772, 343/753, 754, 901, 909; 342/376, 372

(56) References Cited

U.S. PATENT DOCUMENTS 5,420,598 A 5/1995 Uematsu et al. ..... 343/765
5,579,019 A 11/1996 Uematsu et al. ..... 343/771
6,259,415 B1 7/2001 Kumpfbeck et al. ..... 343/765
6,426,814 B1 * 7/2002 Berger et al. ..... 398/45
6,677,899 B1 * 1/2004 Lee et al. ..... 342/376

* cited by examiner

*Primary Examiner*—Don Wong
*Assistant Examiner*—Jimmy Vu
(74) *Attorney, Agent, or Firm*—Kenneth P. Robinson

(57) ABSTRACT

An antenna system, to enable communication with a moving vehicle via a satellite, utilizes an array of subarrays contiguously positioned in a diamond-type pattern. Straight edge boundaries of an array can maximize sidelobe degradation resulting from diffraction effects at the edge. The diamond-type array pattern provides saw tooth array edge boundaries with all edge portions at 45 degrees (or other suitable acute angle) to the principal array dimension (the length dimension). Uniform excitation may be provided for all subarrays via a binomial power divider/combiner configuration. Mechanical beam steering can be provided in azimuth and elevation. A phase shifter assembly may be provided to enable a limited electronic scan (e.g., plus or minus 2 degrees) to increase beam steering agility from a moving vehicle. Thin flat-plate subarray design details are provided.

26 Claims, 7 Drawing Sheets

DIAMOND ARRAY LOW-SIDELOBES FLAT-PLATE ANTENNA SYSTEMS FOR SATELLITE COMMUNICATION

RELATED APPLICATIONS (Not Applicable)

FEDERALLY SPONSORED RESEARCH (Not Applicable)

BACKGROUND OF THE INVENTION

This invention relates to array antennas and, more particularly, to such antennas usable to provide communication with a moving vehicle via satellite.

A variety of forms of antennas have been proposed for point-to-point communication via satellite. In such applications, a radio frequency signal is transmitted from a first antenna providing a beam directed at a satellite, the satellite acts as a repeater re-transmitting received signals, and a second antenna directed at the satellite receives a signal replicating the signal as transmitted from the first antenna. The sequence may be reversed to enable reception at the first antenna of a signal representative of a signal transmitted from the second antenna, to provide two-way communication.

In a form of satellite communication system (referred to generally as a SATCOM system), a series of satellites may be maintained in fixed (GEO) synchronous orbit above the equator, with the satellites in spaced positions along an arc within an equatorial plane. The MILSTAR system is an example of such a system. MILSTAR is a military satellite communication system. Its GEO synchronous satellites transmit at 20 GHz and receive at 45 GHz.

Provision of vehicle-mounted antenna systems suitable for communication via such satellites, while the vehicle is in motion, is subject to a number of constraints. The antenna is desirably of relatively small size and reasonable cost. Thus, while a two-dimensional fully electronically scannable phased-array type antenna might be considered, cost would generally be prohibitive and low angle (low elevation) scanning would typically be limited. Additional constraints are requirements for adequate antenna gain, with the largest possible beamwidth to enhance signal capture, but with low sidelobe performance. Low sidelobes are particularly important in order to enable discrimination between signal transmission/reception characteristics (i.e., antenna patterns) of adjacent satellites to avoid interference during signal reception and transmission from a vehicle. Known forms of prior antennas have generally not been capable of meeting all constraints relevant to such applications.

Objects of the present invention are, therefore, to provide new or improved antenna systems suitable for communication via satellite and antenna systems providing one or more of the following capabilities or characteristics:

- diamond-type array configuration with reduced diffraction effects;
- low sidelobes in principal beam planes;
- reduced sidelobe levels relative to a rectangular-type array;
- satellite tracking capability from a vehicle moving over terrain;
- thin construction with flat-plate subarrays;
- ultra-thin flat-plate subarray design;
- cost effective design; and
- compact size.

SUMMARY OF THE INVENTION

In accordance with the invention, in a first embodiment an antenna system, to enable communication with a moving vehicle via a satellite, includes an array comprising subarrays positioned in a two-dimensional arrangement including subarrays in columns parallel to the length dimension of the array. The array includes a plurality of such subarrays each of nominally square form with four sides, each side aligned at nominally 45 degrees to the length dimension of the array. Each individual subarray of the plurality of subarrays includes at least one slotted waveguide extending nominally parallel to a side of the individual subarray. The antenna system further includes a signal port and a feed configuration to couple signals between the signal port and each subarray.

Further in accordance with the invention, the array of an antenna system may comprise flat-plate type subarrays contiguously positioned in a diamond-type pattern and arranged for uniform excitation via the feed configuration. More generally stated, an array may include a plurality of subarrays each of nominally parallelogram form and each including radiating elements and having sides aligned at an angle in the range of 30 to 60 degrees to the length dimension of the array. An antenna system may further include phase shifters coupled to the feed configuration to enable limited electronic beam scan within an angular range up to two degrees off array boresight, for example. Scan assemblies to mechanically rotate the array in azimuth and mechanically tilt the array for elevation scan may also be included in an antenna system.

For a better understanding of the invention, together with other and further objects, reference is made to the accompanying drawings and the scope of the invention will be pointed out in the accompanying claims.

DESCRIPTION OF THE INVENTION

Figure 1:
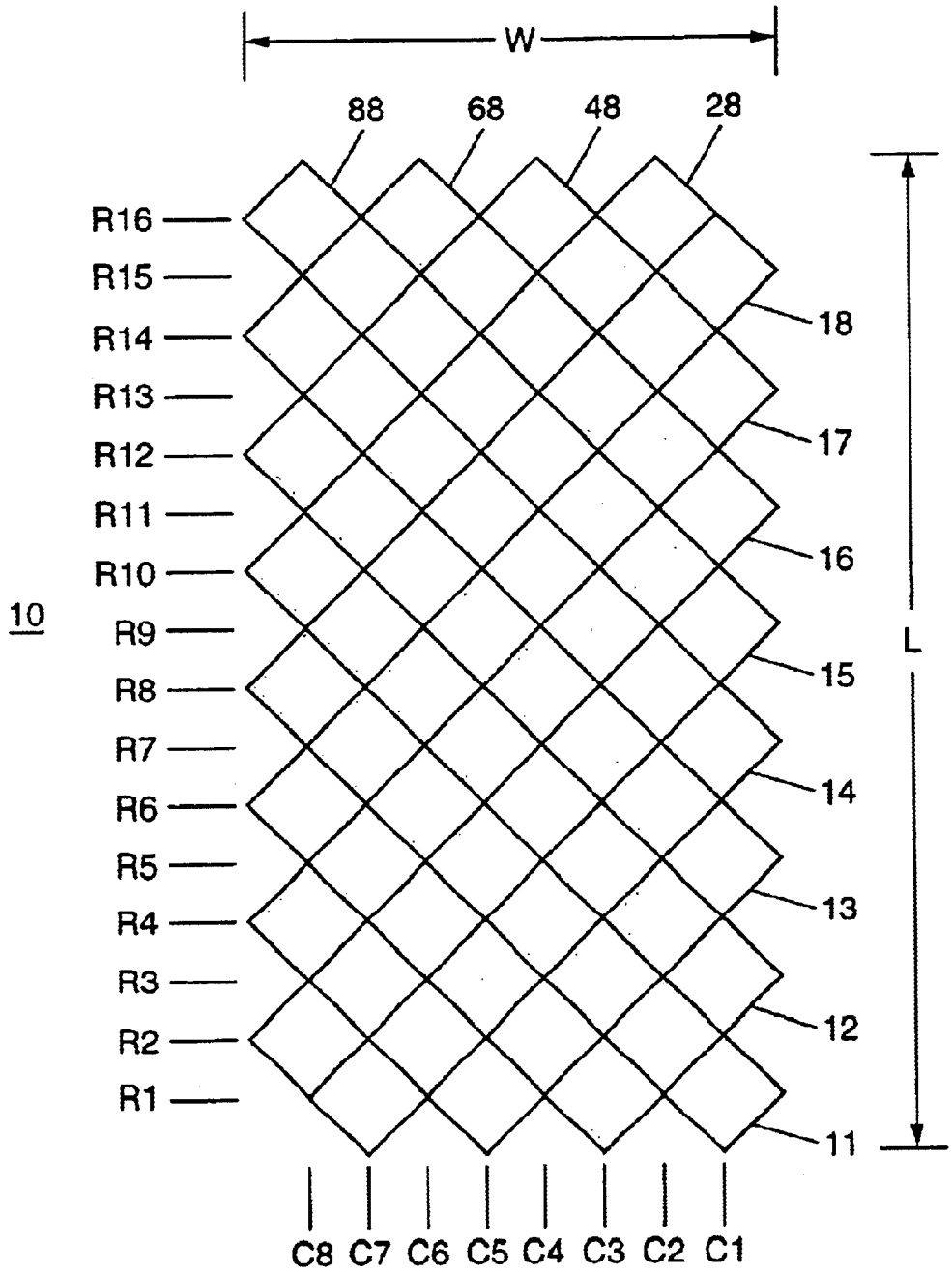
FIG. 1 is a plan view of an antenna system comprising an array of 64 subarrays positioned in a diamond-type pattern.

FIG. 1 is a simplified front view of an antenna system configured to enable communication with a moving vehicle via a satellite, such as a satellite of a SATCOM system. The antenna system comprises an array 10 formed of flat-plate subarrays positioned in a two-dimensional diamond-type pattern.

As shown, the subarrays are positioned in rows (i.e., rows R1–R16) and columns (i.e., columns C1–C8). The subarrays in column C1 are identified more specifically as subarrays 11, 12, 1.3, 14, 15, 16, 17, 18, by way of example. Thus, in this embodiment, each column includes eight subarrays and each row includes four subarrays. The subarrays in row R16 are identified more specifically as subarrays 28, 48, 68, 88, by way of example. As indicated in FIG. 1, array 10 has a length dimension L parallel to the columns C1–C8 of the subarrays and a width dimension W parallel to the rows R1–R16 of the subarrays.

In FIG. 1 the included subarrays (e.g., subarrays 11–18) are each in the form of a rectangular parallelogram (i.e., a square) with four sides, each of which is aligned at 45 degrees to both the length dimension L and the width dimension W of array 10. In this embodiment, each of the 64 subarrays, of which subarrays 11–18 are representative, is nominally of the same size, shape and construction. Production of identical items may be unattainable for practical quality control considerations and in some implementations differences may be intentionally provided. The term "nominally" is defined as within plus or minus twenty percent of a referenced size, dimension or other characteristic. In other implementations, a diamond-type pattern may be provided with use of parallelogram shaped subarrays which are not square, with the parallelograms having sides aligned at an angle in the range of 30 to 60 degrees to the length dimension of an array.

Figure 2:
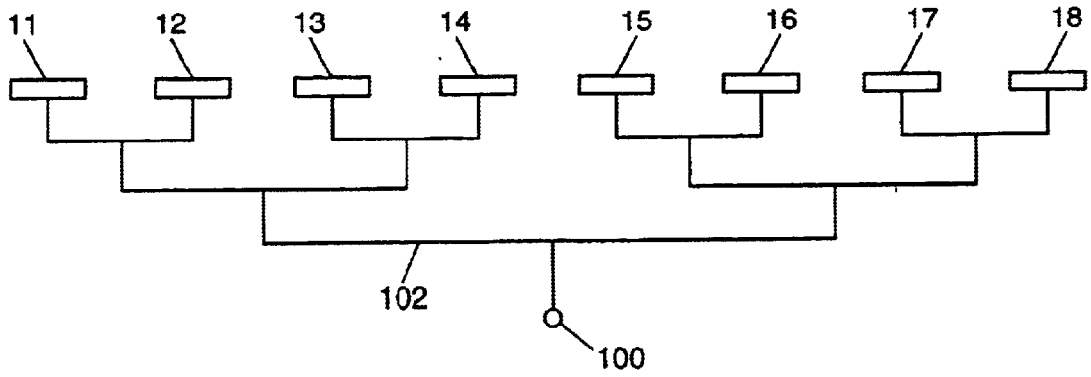
FIG. 2 shows a representative portion of the feed configuration of the FIG. 1 antenna system.

In the FIG. 1 embodiment, each of the 64 subarrays is arranged for uniform excitation. FIG. 2 illustrates a partial circuit for a binary feed configuration to provide uniform excitation of subarrays. In FIG. 2, a signal port 100 is coupled to feed configuration 102, which is arranged to couple signals between the signal port 100 and each of the subarrays 11–18 of column C1 of FIG. 1. Subarrays 11–18 are represented in side view in spaced relation for purposes of illustration. To follow through on this illustration, the eight subarrays of each of the additional columns C2–C8 would each be coupled to a replication of the feed configuration 102 of FIG. 2 and all eight of the resulting 102 type of feed configurations would in turn be fed by binary interconnections (i.e., column-to-column) to enable the eight 102 type feeds to be uniformly excited via a single signal port (e.g., port 100). It will be appreciated that reciprocal operation attains, so that for transmission a signal supplied to port 100 would uniformly excite all 64 subarrays in this example, whereas for reception signals received via each subarray would be combined with equal weighting by the composite feed configuration and made available at port 100 for further processing. For particular embodiments, skilled persons having an understanding of the invention will be enabled to implement different forms of feed configurations, which may provide non-uniform excitation for example, as suitable to meet particular objectives.

Figure 3:
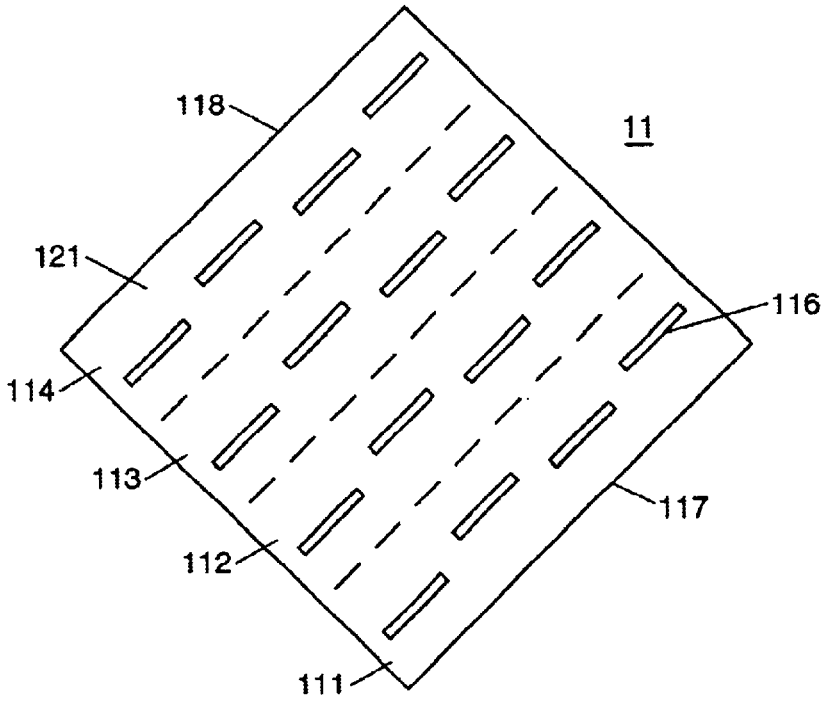
FIG. 3 is a plan view of a representative subarray of the FIG. 1 antenna system.
Figure 4:
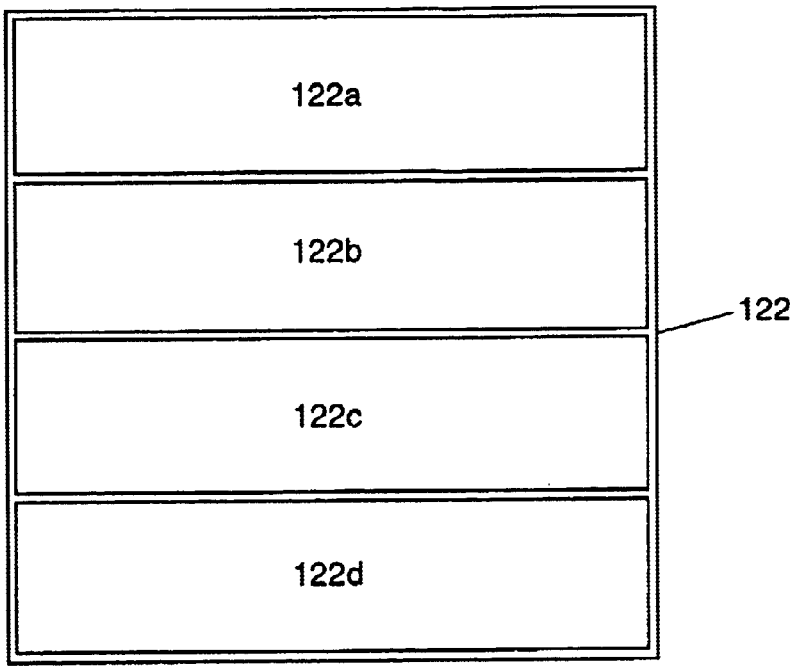
FIGS. 4, 5, 6 and 7 are plan views of constituent plates of the FIG. 3 subarray which are successively positioned below the top plate visible in FIG. 3.

FIG. 3 is an enlarged front view of subarray 11, which is representative of each of the 64 subarrays included in the two-dimensional array 10 of FIG. 1. As will be further described, subarray 11 is of flat-plate construction and includes at least one slotted waveguide extending nominally parallel to a side of the individual subarray. As illustrated, subarray 11 includes four slotted waveguides 111, 112, 113, 114. While not visible on the face of the subarray 11, separations between the waveguides are represented by dashed lines in FIG. 3. In this embodiment, each of the side-by-side waveguides 111–114 includes a series of four longitudinal slots, of which slot 116 is representative. Thus, subarray 11 includes four slotted waveguides, each extending parallel to sides 117 and 118 of the subarray.

Figure 5:
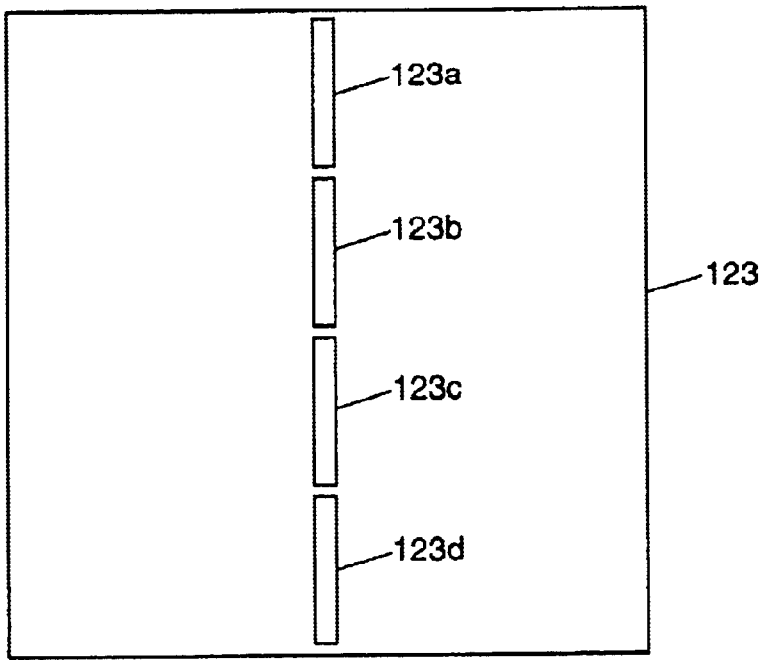
Figure 6:
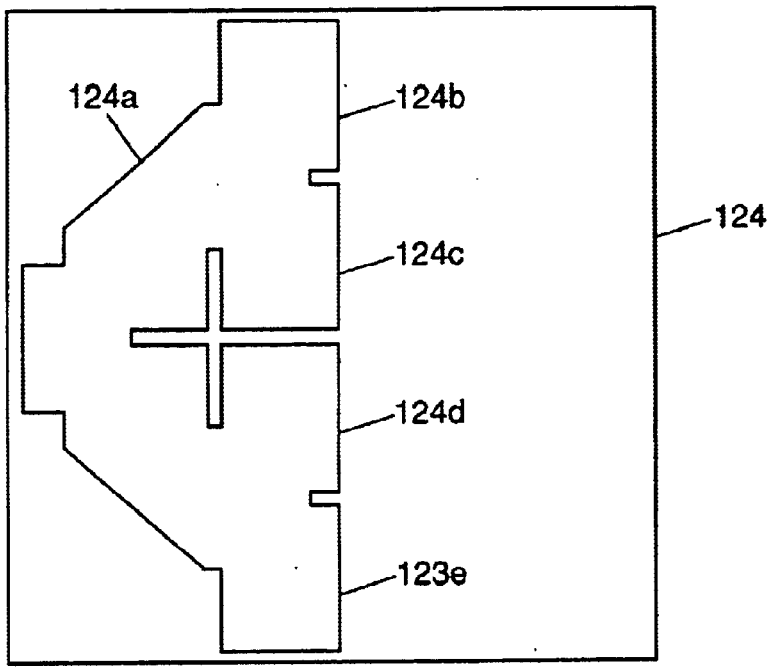
Figure 7:
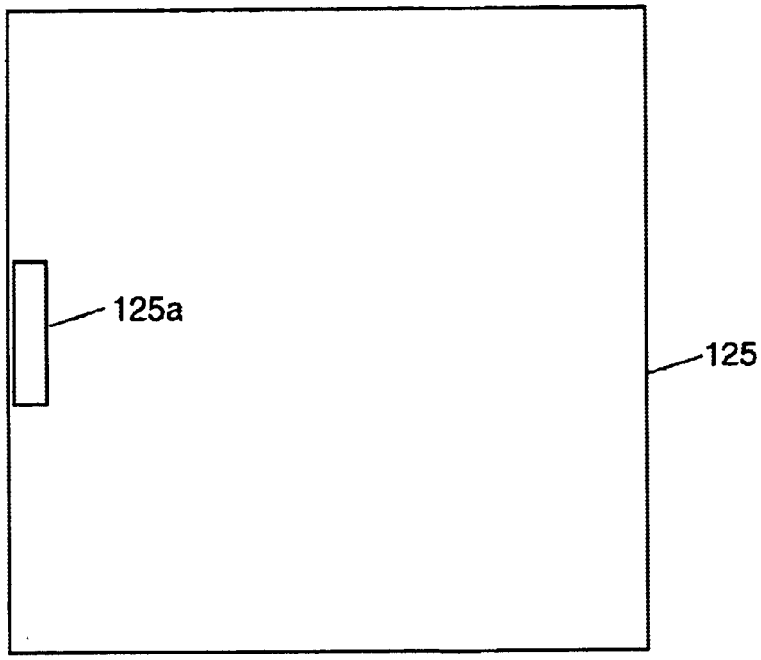

Construction elements of a flat-plate subarray (e.g., representative subarray 11) are illustrated in FIGS. 3–7, each of which shows a square portion of a metallic sheet (i.e., a "plate") in which openings have been formed. Figures are not necessarily to scale. Beginning with the bottom plate 125, shown in FIG. 7, this plate has a single opening 125*a* arranged to function as an input/output port coupled to each of the 16 slots of subarray 11. Signals introduced via this port from below plate 125 are fed into a more complex signal distribution chamber 124*a* formed in plate 124, which is designed to equally distribute a signal introduced at its left terminus (from port 125*a*) to the four extensions 124*b*, 124*c*, 124*d*, 124*e* shown at the right side of opening 124*a*. Those four right side extensions of distribution chamber 124*a* are divided signal regions effective to couple a portion of the feed signals to each of the respective feed openings 123*a*, 123*b*, 123*c*, 123*d* of plate 123 as shown in FIG. 5. Those four feed openings of plate 123 in turn feed signals to the openings 122*a*, 122*b*, 122*c* and 122*d* of plate 122, which are proportioned to function as waveguides when enclosed bottom and top by the plates 123 and 121. With the inclusion of top plate 121, which is visible in FIG. 3, each such waveguide is configured as one of the slotted waveguides 111, 112, 113, 114 of FIG. 3, arranged to each provide nominally uniform excitation of four slot radiating elements, of which slot 116 is representative. It is noted that while top plate 121 is shown in FIG. 3 in its alignment for inclusion in the diamond-type pattern of the FIG. 1 array, plates 122, 123, 124, 125 in FIGS. 4–7 are shown rotated clockwise 45 degrees for purposes of illustration.

It will be seen that subarray 11, as described, is an antenna system in the form of a stack of conductive layers as illustrated in FIGS. 7, 6, 5, 4, 3. As discussed, base layer 125 has an opening 125*a* suitable to receive a radio frequency (RF) signal. Second layer 124 includes a signal distribution chamber 124*a* including a first portion aligned with opening 125*a* and a plurality of four divided signal regions 124*b*, 124*c*, 124*d*, 124*e* to receive respective portions of the RF signal. Third layer 123 has a plurality of openings 123*a*, 123*b*, 123*c*, 123*d*, one aligned with each of the divided signal regions 124*b*, 124*c*, 124*d*, 124*e*, with each such opening suitable to receive one of the portions of the RF signal. Fourth layer 122 has a plurality of parallel waveguide configurations, each aligned with one of the openings 123*a*, 123*b*, 123*c*, 123*d*, with each waveguide configuration suitable to receive one of the portions of the RF signal. Top layer 121 has an arrangement of slot radiating elements positioned above each of the waveguides 111, 112, 113, 114 which are formed when the waveguide configurations 122*a*, 122*b*, 122*c*, 122*d* of layer 122 are placed in position between layers 123 and 121, as discussed.

In a currently preferred embodiment of subarray 11, nominal thickness of plates 121, 123 and 125 is 0.03 inches, of plate 122 is 0.06 inches and of plate 124 is 0.1 inches. Thus, with this configuration each of the 64 thin-plate subarrays of FIG. 1 may have a thickness of approximately one-quarter inch, independent of the further thickness necessitated to implement feed configurations 102 of FIG. 2 and related elements of a complete antenna system. With reference to FIG. 3, for operation in a SATCOM 20.2–21.2 GHz signal reception band, the slots (e.g., slot 116) may have approximate dimensions of 0.29 inches in length, 0.03 inches in width, with 0.45 inch center-to-center slot spacing along each waveguide and 0.07 inch center-to-center lateral slot spacing symmetrical to the centerline of each waveguide. For this application, the overall length and width dimensions of the square flat-plate subarray of FIG. 3 may be approximately 1.75×1.75 inches. Consistent with the above, in this embodiment, the overall length and width dimensions of the complete array 10 of FIG. 1 would be approximately 21×12.25 inches. With use of the subarrays having a thickness of approximately one-quarter inch, suitable implementation of eight of the 102 type feed networks, plus feed connections to uniformly excite these eight feed networks, may be implemented in similar or other appropriate manner by skilled persons to provide a complete implementation of array 10 (with uniform excitation of all 64 subarrays via a single input/output port). In this manner array 10 may be implemented with an overall thickness of approximately one-half inch. In particular applications a frontal polarizer plate (e.g., linear to circular) may be included with the array, somewhat increasing overall thickness.

While the same antenna system can, in general, be used for signal transmission as well as reception, for transmission of signals to a satellite, a SATCOM system may utilize a frequency range of 30.0–31.0 GHz. For such SATCOM transmission usage, an array which is identical in form to array 10 of FIG. 1, but dimensionally smaller, can be employed. Thus, the overall length and width dimensions discussed above can appropriately be reduced to approximately 14×8.25 inches for use in the 30.0–31.0 GHz transmit band. The dimensions of the individual subarrays, slots, etc., may also be proportionately reduced for such an application.

Array 10, with uniform excitation as described, is effective to provide computed antenna pattern characteristics including array gain of 36.1 dBi, L plane beamwidth of 1.47 degrees and W plane beamwidth of 2.94 degrees. The antenna beam as described is projected normal to the face of the array and mechanical provision for beam steering in azimuth and elevation can be provided as appropriate for practical implementation of the antenna system. Basically, to accomplish such beam steering, in order to aim the beam and track the position of a satellite in the presence of vehicle motion, the array can be mechanically rotated (e.g., 360 degrees in azimuth) by a suitable azimuth scan assembly, to provide steering in azimuth, and mechanically tilted (e.g., over a 0 to 90 degree range in elevation) by a suitable elevation scan assembly, to provide steering in elevation. With an understanding of the invention, skilled persons using available techniques will be enabled to provide mechanical beam steering implementations as appropriate for particular applications. By way of example, mechanical rotation and tilt arrangements for antenna beam azimuth and elevation steering in the context of reception of satellite-transmitted television signals are disclosed in U.S. Pat. Nos. 6,259,415; 5,579,019; and 5,420,598. The content of U.S. Pat. No. 6,259,415, having a common assignee with the present invention, is hereby incorporated herein by reference. Thus, in addition to the antenna elements already described, pursuant to the invention an antenna system may additionally comprise an azimuth scan assembly to position the array 10 in azimuth and an elevation scan assembly to tilt the array. While not specifically shown or described in detail herein, drawings and descriptions of examples of one form of such assemblies are made available by incorporation from the U.S. Pat. No. 6,259,415 and alterations and variations thereof can be provided by skilled persons, as appropriate.

In a SATCOM type application for use on ground-based motor vehicles to permit communication from moving vehicles, mechanical azimuth and elevation beam scanning can be augmented by provision of a limited electronic scan capability. Thus, for an antenna system mounted on a moving truck, for example, vehicle movement dynamics (e.g., with changing vehicle speed, direction, tilt, etc.) may exceed the capabilities of satellite tracking by mechanical azimuth and elevation scanning and augmentation by limited electronic scan is effective to provide an appropriate level of beam scan agility. A hybrid scan approach can be employed to add limited electronic scan (e.g., a dither type scan with plus and minus 2 degree capability in azimuth and elevation). By this approach, the cost effectiveness of mechanical scan is retained and the additional scan capability required in the moving vehicle context is provided by limited electronic scan which can be implemented at reasonable cost.

Figure 8:
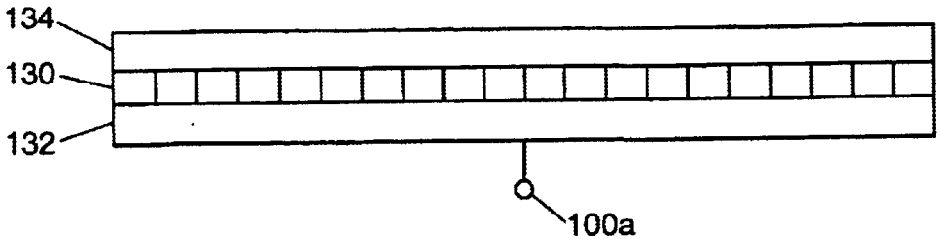
FIG. 8 is a side-view representation of an array of subarrays with a polarization changing layer.
Figure 9:
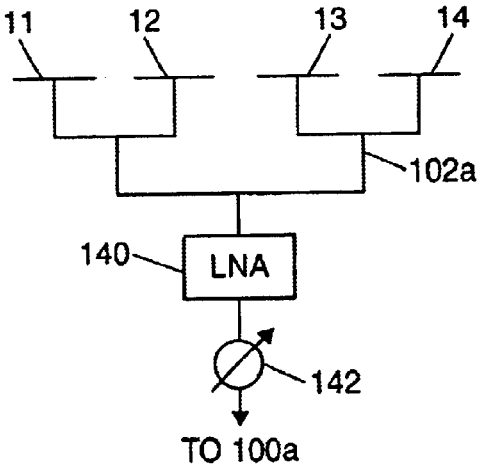
FIG. 9 shows a feed portion with a phase shifter for limited electronic scan in a receive antenna system.

FIG. 8 is a not to scale side-view representation of the FIG. 1 array with inclusion of the subarrays represented as layer 130, a feed/amplifier/phase shift assembly represented at 132 and a frontal polarizer represented at 134. In this configuration, using know techniques for phase shifter activation and control the antenna system may be configured to implement limited electronic beam scan (e.g., plus or minus 2 degrees off boresight). As shown, a known type of polarization-changing layer or plate 134 is positioned on the face of array 10. This is effective, for example, to change incident circularly polarized SATCOM signals to linearly polarized signals suitable for interaction with the slotted subarrays. Shown positioned behind the subarray configuration layer 130 in FIG. 8 is an assembly 132. As illustrated in FIG. 9, assembly 132 which may include a low noise amplifier (LNA) 140 and phase shifter 142 combination coupled via a two-step binomial power divider/combiner 102*a* to four subarrays 11, 12, 13, 14. With this arrangement, 16 such LNA amplifier/phase shifter combinations would be required for the 64 subarrays of array 10. Thus, in this example the feed configuration is provided in two portions, four-to-one power dividers/combiners between the subarrays and the LNA amplifier/phase shifter combinations and a further power divider/combiner arrangement between the LNA amplifier/phase shifter combinations and a single signal output represented by the output port 100*a*.

Figure 10:
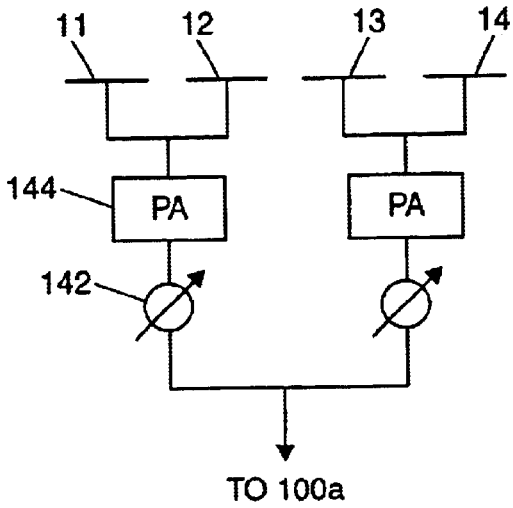
FIG. 10 shows a feed portion with a phase shifter for limited electronic scan in a transmit antenna system.

For a transmit implementation, polarization changer 134 is effective to change linearly polarized signals radiated by the array to circularly polarized signals suitable for satellite reception. In the transmit implementation, assembly 132 may be modified to utilize power amplifiers (PA) instead of low noise amplifiers. In this case, as shown in FIG. 10 assembly 132 may include a power amplifier 144 and phase shifter 142 in combination coupled via a one-step power divider to two subarrays 11, 12, so that 32 such amplifier/phase shifter combinations would be required to feed the 64 subarrays of array 10 in FIG. 1. With inclusion of active elements, such as phase shifters and amplifiers a limited electronic-beam scan capability can be implemented using known techniques, while maintaining cost effectiveness of the design. While particular implementations are described by way of example, other arrangements and variations regarding receive and transmit configurations may be provided by skilled persons.

Operationally, as noted above antenna system size, cost and performance characteristics are important considerations. Array 10 incorporating flat-plate subarrays enables provision of a thin array of relatively small size and cost reflects benefits of simplification through the use of identical subarrays with uniform excitation. In operation with a series of satellites positioned along an equatorial arc, as in a SATCOM system, a low sidelobe antenna pattern characteristic is important in avoiding undesired interference or interaction with more than one satellite at the same time. With the structure of array 10 as illustrated in FIG. 1, it will be seen that each of the top and bottom and left and right edges of the composite array has a saw-tooth type edge region, with each portion of each such edge structure (e.g., each side of each saw tooth) having a 45 degree alignment with the length (L) and width (W) dimensions of the array. Whereas provision in prior art types of antennas of linear left, right, top and bottom edges of an array can be effective to maximize diffraction effects operative at those edges to degrade sidelobe performance, the FIG. 1 provision of 45 degree aligned edge portions tends to minimize such diffraction effects. As a result, sidelobe performance is enhanced.

Figure 11:
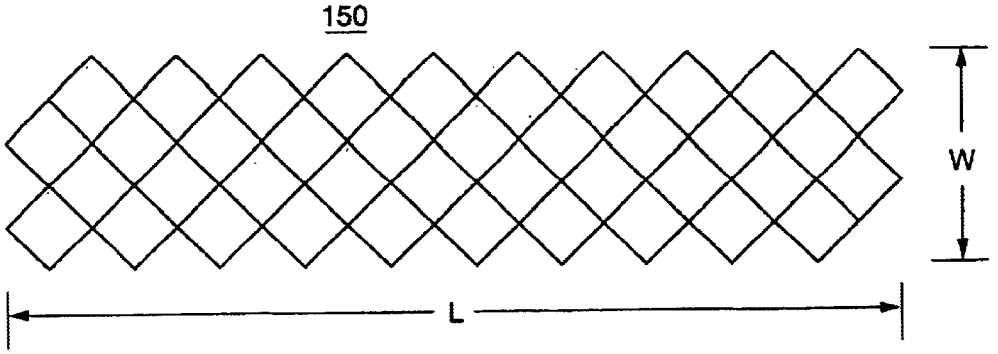
FIG. 11 shows an embodiment of a diamond-type array.
Figure 12:
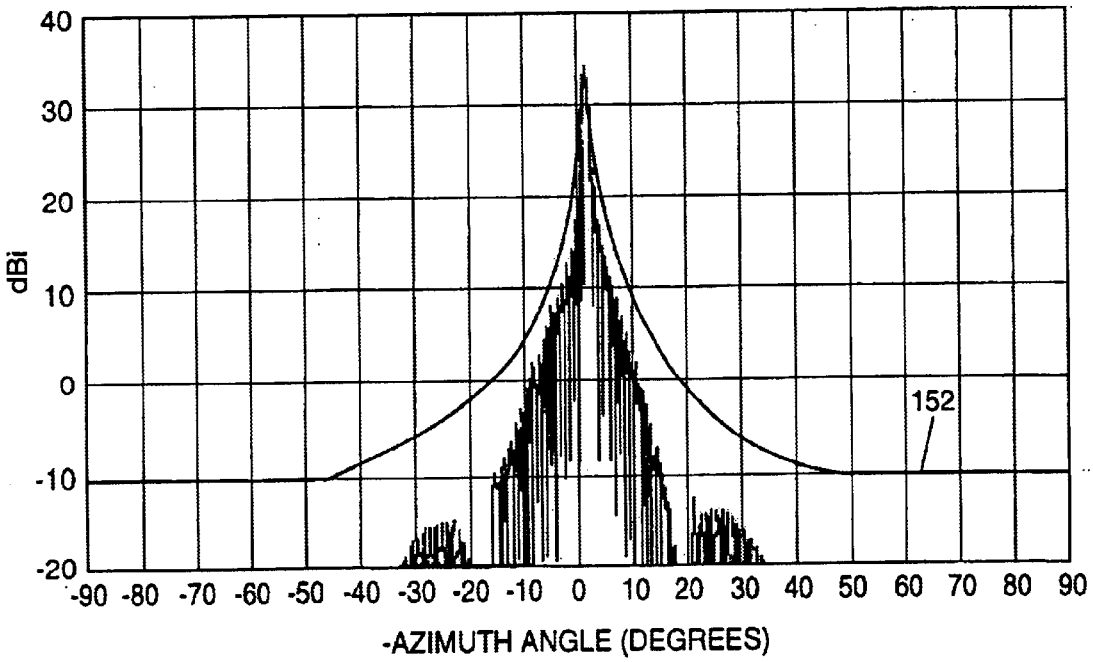
FIG. 12 is a computed antenna pattern for the FIG. 11 array.
Figure 13:
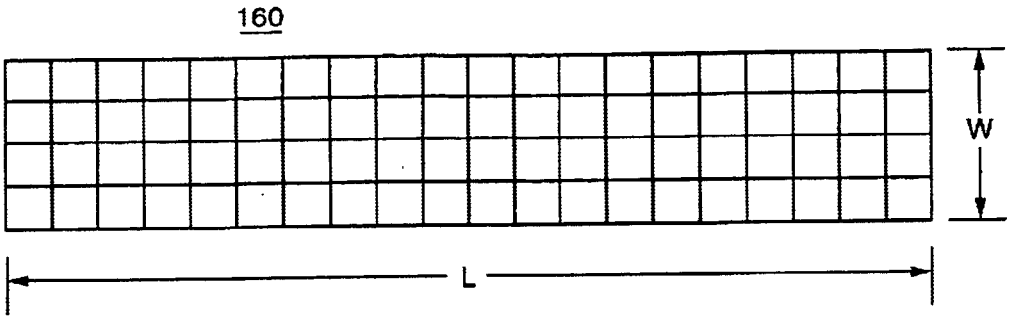
PRIOR ART FIG. 13
FIG. 13 shows a form of rectangular array for purposes of comparison.
Figure 14:
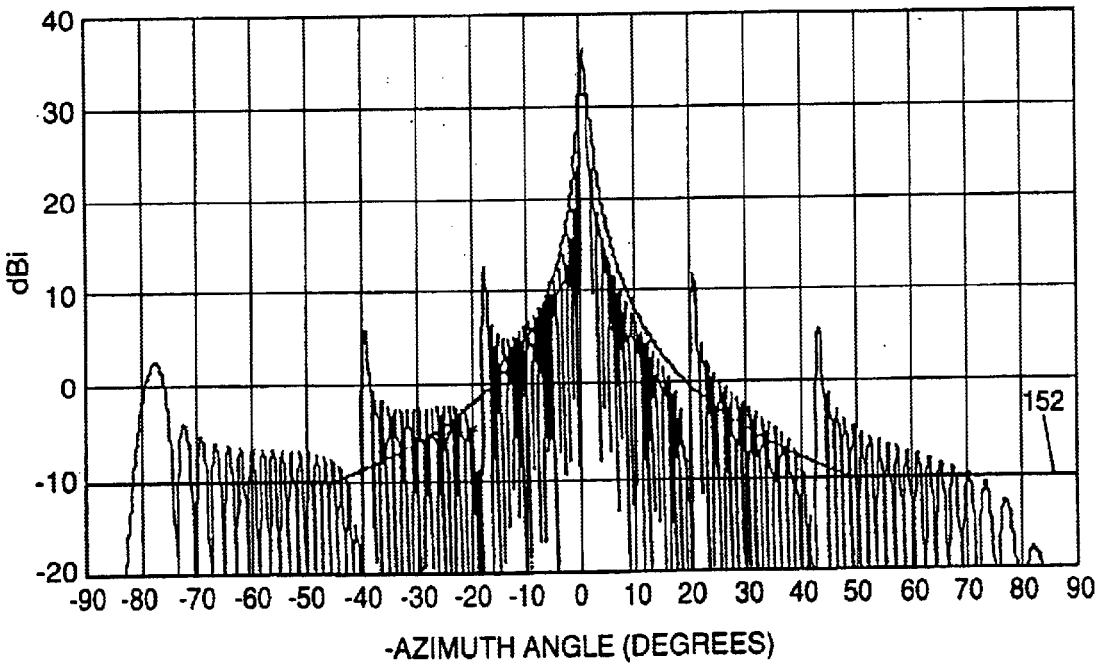
PRIOR ART FIG. 14
FIG. 14 is a computed antenna pattern for the FIG. 13 array.

FIG. 11 shows a diamond-type array 150, of the type described above, which includes 40 subarrays and has a length dimension (L) of approximately 40 inches and a width dimension (W) of approximately 9 inches. The computed antenna pattern in the plane of the L dimension (azimuth plane) is shown in FIG. 12 for operation at a SATCOM receive frequency of 20.2 GHz in the presence of one degree beam scan. In FIG. 12, profile line 152 represents the maximum sidelobe radiation level standard established by the International Telecommunication Union (standard ITU-RS.465) to control interference relative to operation of adjacent or other satellites. The INTELSAT Earth Station Standard (IESS-601) is somewhat more stringent in providing that sidelobes within plus or minus 20 degrees of antenna boresight be suppressed by an additional 3 dB. For comparison purposes, FIG. 13 shows an array 160 which includes 80 flat-plate subarrays in a rectangular-type configuration having an L dimension of approximately 35 inches and a W dimension of approximately 7 inches. The computed antenna pattern in the plane of the L dimension (azimuth plane) is shown in FIG. 14 for reception at 20.2 GHz with one degree beam scan. As indicated, sidelobe performance shown in FIG. 14 is much poorer than that shown in FIG. 12 and significantly fails to meet the ITU standard represented by profile line 152.

While there have been described the currently preferred embodiments of the invention, those skilled in the art will recognize that other and further modifications may be made without departing from the invention and it is intended to claim all modifications and variations as fall within the scope of the invention.

What is claimed is:

1. An antenna system, to enable communication with a moving vehicle via a satellite, comprising:

an array comprising subarrays positioned in a two-dimensional arrangement including subarrays in columns parallel to the length dimension of the array;

the array including a plurality of said subarrays each of nominally square form with four sides, each said side aligned at nominally 45 degrees to said length dimension of the array;

each individual subarray of said plurality of subarrays including at least one slotted waveguide extending nominally parallel to a side of the individual subarray;

a signal port; and a feed configuration to couple signals between the signal port and each subarray.

2. An antenna system as in claim 1, wherein each individual subarray of said plurality includes four slotted waveguides in parallel side-by-side arrangement and each waveguide includes at least one row of slots extending nominally parallel to a side of the individual array.

3. An antenna system as in claim 1, wherein said length dimension is parallel to the plane of the antenna beam in which said beam has its minimum beamwidth.

4. An antenna system as in claim 1, wherein the subarrays are arranged for uniform excitation via said feed configuration.

5. An antenna system as in claim 1, wherein the array comprises flat-plate type subarrays contiguously positioned in a diamond-type pattern.

6. An antenna system as in claim 1, additionally comprising:

phase shifters coupled to the feed configuration and arranged to enable limited electronic beam scan.

7. An antenna system as in claim 1, wherein said phase shifters are arranged to enable electronic beam scan limited to an angular range up to two degrees off array boresight.

8. An antenna system as in claim 1, additionally comprising:

an azimuth scan assembly to mechanically rotate said array in azimuth.

9. An antenna system as in claim 8, additionally comprising:

an elevation scan assembly to mechanically tilt said array.

10. An antenna system, to enable communication via satellite, comprising:

an array comprising subarrays positioned in a two-dimensional arrangement including subarrays in columns nominally parallel to the length dimension of the array;

the array including a plurality of said subarrays each of nominally parallelogram form and each having sides aligned at an angle in the range of 30 to 60 degrees to said length dimension of the array;

each individual subarray of said plurality of subarrays including radiating elements;

a signal port; and a feed configuration to couple signals between the signal port and each subarray.

11. An antenna system as in claim 10, wherein each subarray of said plurality of subarrays is nominally one of square and rectangular.

12. An antenna system as in claim 10, wherein each individual subarray includes at least one row of radiating elements.

13. An antenna system as in claim 12, wherein each said row of radiating elements is a row of slots.

14. An antenna as in claim 13, wherein each row of slots is nominally parallel to a side of a subarray.

15. An antenna system as in claim 10, wherein each individual subarray includes at least one slotted waveguide configuration extending nominally parallel to a side of the individual subarray and said radiating elements are slots in said waveguide.

16. An antenna system as in claim 15, wherein each subarray includes four slotted waveguides in parallel side-by-side arrangement.

17. An antenna system as in claim 10, wherein said length dimension is parallel to the plane of the antenna beam in which said beam has its minimum beamwidth.

18. An antenna system as in claim 10, wherein the subarrays are arranged for uniform excitation via said feed configuration.

19. An antenna system as in claim 10, wherein the array comprises flat-plate type subarrays contiguously positioned in a diamond-type pattern.

20. An antenna system as in claim 10, additionally comprising:

phase shifters coupled to the feed configuration and arranged to enable limited electronic beam scan.

21. An antenna system as in claim 20, wherein said phase shifters are arranged to enable electronic beam scan limited to an angular range up to two degrees off array boresight.

22. An antenna system, in the form of a stack of layers, comprising:

a base layer having an opening suitable to receive a radio-frequency signal;

a second layer having a signal distribution chamber including a first section aligned with said opening to receive said signal and a plurality of divided signal regions to receive respective portions of said signal;

a third layer having a plurality of openings, one aligned with each said divided signal region, each opening of said plurality suitable to receive one of said portions of said signal;

a fourth layer having a plurality of parallel waveguide configurations each aligned with one opening of said plurality of openings and suitable to receive one of said portions of said signal; and a top layer having an arrangement of slot radiating elements positioned above each of the waveguide configurations, said slot radiating elements suitable to radiate signals;

each said layer comprising a conductive layer of predetermined thickness and having at least one opening extending therethrough.

23. An antenna system as in claim 22, wherein each said layer is formed of metal.

24. An antenna system as in claim 22, wherein the fourth layer includes four parallel openings, each comprising a waveguide configuration.

25. An antenna system as in claim 22, wherein the top layer includes, above each waveguide configuration, a series of slots each having its length aligned parallel to the length of the respective waveguide configuration.

26. An antenna system as in claim 22, wherein said layers are stacked, each with at least one main surface in contact with a main surface of another of said layers.

* * * * *